US007591240B2

(12) United States Patent
Dirker

(10) Patent No.: US 7,591,240 B2
(45) Date of Patent: Sep. 22, 2009

(54) METHOD FOR PROVIDING A MIXTURE OF AIR AND EXHAUST

(75) Inventor: Martin W. Dirker, Bourne (GB)

(73) Assignee: Perkins Engines Company Limited, Peterborough (GB)

( * ) Notice: Subject to any disclaimer, the term of this patent is extended or adjusted under 35 U.S.C. 154(b) by 0 days.

(21) Appl. No.: 12/000,569

(22) Filed: Dec. 13, 2007

(65) Prior Publication Data

US 2008/0163845 A1 Jul. 10, 2008

Related U.S. Application Data

(60) Provisional application No. 60/877,363, filed on Dec. 28, 2006.

(51) Int. Cl.
*F01L 7/00* (2006.01)

(52) U.S. Cl. ..... 123/190.1

(58) Field of Classification Search ..... 123/190.1, 123/190.2, 190.13–14, 80 R, 80 BA, 80 BB
See application file for complete search history.

(56) References Cited

U.S. PATENT DOCUMENTS 4,198,946 A * 4/1980 Rassey ..... 123/190.17
4,944,261 A 7/1990 Coates
4,953,527 A 9/1990 Coates
4,969,918 A * 11/1990 Taniguchi ..... 123/190.2
4,976,232 A 12/1990 Coates
4,989,558 A 2/1991 Coates
4,989,576 A * 2/1991 Coates ..... 123/80 D
5,109,814 A 5/1992 Coates
5,205,251 A * 4/1993 Conklin ..... 123/190.12
5,361,739 A 11/1994 Coates
5,572,967 A * 11/1996 Donaldson, Jr. ..... 123/190.12
5,711,265 A * 1/1998 Duve ..... 123/190.2
6,308,676 B1 10/2001 Coates
6,390,048 B1 * 5/2002 Luchansky ..... 123/190.1
6,443,116 B1 * 9/2002 Dahlborg ..... 123/190.6
6,651,605 B2 * 11/2003 Trentham ..... 123/190.8
6,666,458 B2 12/2003 Coates
6,691,664 B2 * 2/2004 Pisano et al. ..... 123/190.2
6,718,933 B1 4/2004 Coates
6,763,788 B2 * 7/2004 Wallis ..... 123/80 BA (Continued)

FOREIGN PATENT DOCUMENTS

EP 0518832 12/1992

(Continued)

*Primary Examiner*—Michael Cuff
*Assistant Examiner*—Hung Q Nguyen
(74) *Attorney, Agent, or Firm*—Finnegan, Henderson, Farabow, Garrett & Dunner

(57) ABSTRACT

A method for providing a mixture of inlet air and exhaust gas in a cylinder of an internal combustion engine is disclosed. Fluid flow between the cylinder and a cylinder head associated therewith is controlled by at least one rotary valve accommodated in the cylinder head. The method includes rotating the at least one rotary valve to allow a fluid flow between the cylinder and the cylinder head in a first direction and to allow a fluid flow between the cylinder and the cylinder head in a second direction, opposite the first direction, wherein the fluid flow in the first direction and the fluid flow in the second direction are allowed during a single combustion cycle of the engine.

17 Claims, 13 Drawing Sheets

U.S. PATENT DOCUMENTS

| | | | | |
|---|---|---|---|---|
| 6,779,504 | B2 | 8/2004 | Coates | |
| 6,789,516 | B2 | 9/2004 | Coates | |
| 6,880,511 | B1 | 4/2005 | Coates | |
| 7,044,097 | B2 * | 5/2006 | Wright | 123/190.5 |
| 2001/0029918 | A1 * | 10/2001 | Qattan | 123/190.1 |
| 2006/0102130 | A1 * | 5/2006 | Bachelier | 123/190.4 |
| 2007/0017477 | A1 * | 1/2007 | Zajac | 123/190.1 |
| 2007/0266983 | A1 * | 11/2007 | Thomas et al. | 123/190.1 |
| 2008/0156286 | A1 | 7/2008 | Dirker | |
| 2008/0156287 | A1 | 7/2008 | Dirker | |
| 2008/0156289 | A1 | 7/2008 | Dirker | |
| 2008/0210190 | A1 | 9/2008 | Dirker | |
| 2008/0210191 | A1 | 9/2008 | Dirker | |
| 2008/0210192 | A1 | 9/2008 | Dirker | |
| 2008/0210311 | A1 | 9/2008 | Dirker | |

FOREIGN PATENT DOCUMENTS

| | | |
|---|---|---|
| IN | 184081 | 2/1994 |
| IN | 98MAS2220 | 10/1998 |
| IN | P8MAS2221 | 10/1998 |
| IN | 184081 | 6/2000 |
| JP | 60 240812 | 11/1985 |
| JP | 2004 108287 | 4/2004 |
| ZA | 199000690 | 4/1991 |

* cited by examiner

METHOD FOR PROVIDING A MIXTURE OF AIR AND EXHAUST

This application claims the benefit of U.S. Provisional Application No. 60/877,363, filed Dec. 28, 2006.

TECHNICAL FIELD

The present application relates generally to internal combustion engines and more particularly to providing a mixture of inlet air and exhaust gas in a cylinder of an internal combustion engine.

BACKGROUND

Typical internal combustion engines use poppet vales arranged in a cylinder head to control air flow into and out of cylinders formed in a main body of the internal combustion engines. In order to affect combustion of a fuel-air mixture in the light of emission standards, it has been known to include some exhaust gas in the fuel-air mixture. Different methods have been employed to provide exhaust gas in the fuel-air mixture. One of the methods provides several opening events for the poppet valves during different stages of a combustion cycle to allow, for example, exhaust gas to enter the cylinder during an intake stroke.

Inasmuch as the poppet valves are typically activated by a camshaft, corresponding changes to the camshaft must be made to allow several opening events, which increases their cost of manufacture. Since poppet valves are typically spring biased to a closed position thereof the camshaft must work against the bias of the springs for each opening event, which leads to large energy expenditure for opening of the valves.

Alternative internal combustion engines use, for example, spherical rotary intake and outlet valves as shown in U.S. Pat. No. 6,779,504, issued to Coates on Aug. 24, 2004. Coates describes spherical rotary valves arranged in spherical valve chambers formed in a cylinder head to control intake and exhaust of gases into and from a cylinder of an internal combustion engine. Such spherical rotary valves, however, do not allow the provision of an air-exhaust gas mixture in a cylinder of the internal combustion engine.

The present application is directed to overcoming one or more of the problems set forth above.

SUMMARY

In one aspect, the present disclosure is directed to a method for providing a mixture of inlet air and exhaust gas in a cylinder of an internal combustion engine. Fluid flow between a cylinder and a cylinder head associated therewith is controlled by a rotary valve accommodated in the cylinder head. The rotary valve is rotated in such a manner, that a fluid flow between a cylinder and the cylinder head is allowed in a first direction, and a fluid flow between the cylinder and the cylinder head is allowed in a second direction, opposite the first direction. The fluid flow in the first direction and the fluid flow in the second direction are allowed during a single combustion cycle of the engine.

BRIEF DESCRIPTION OF THE DRAWINGS

FIG. 21(*b*) is a cross-sectional view of an alternative deflector/bearing assembly;

FIG. 24(*b*) is a top view of an internal combustion engine, showing an alternative drive mechanism for driving rotary valves arranged within the cylinder head of the engine;

FIG. 26(*b*) is a top view of an internal combustion engine; and

FIG. 26(*c*) is an enlarged schematic cross-sectional view through a drive motor; wherein a further alternative drive mechanism for driving rotary valves arranged within the cylinder head is shown.

DETAILED DESCRIPTION

Figure 1:
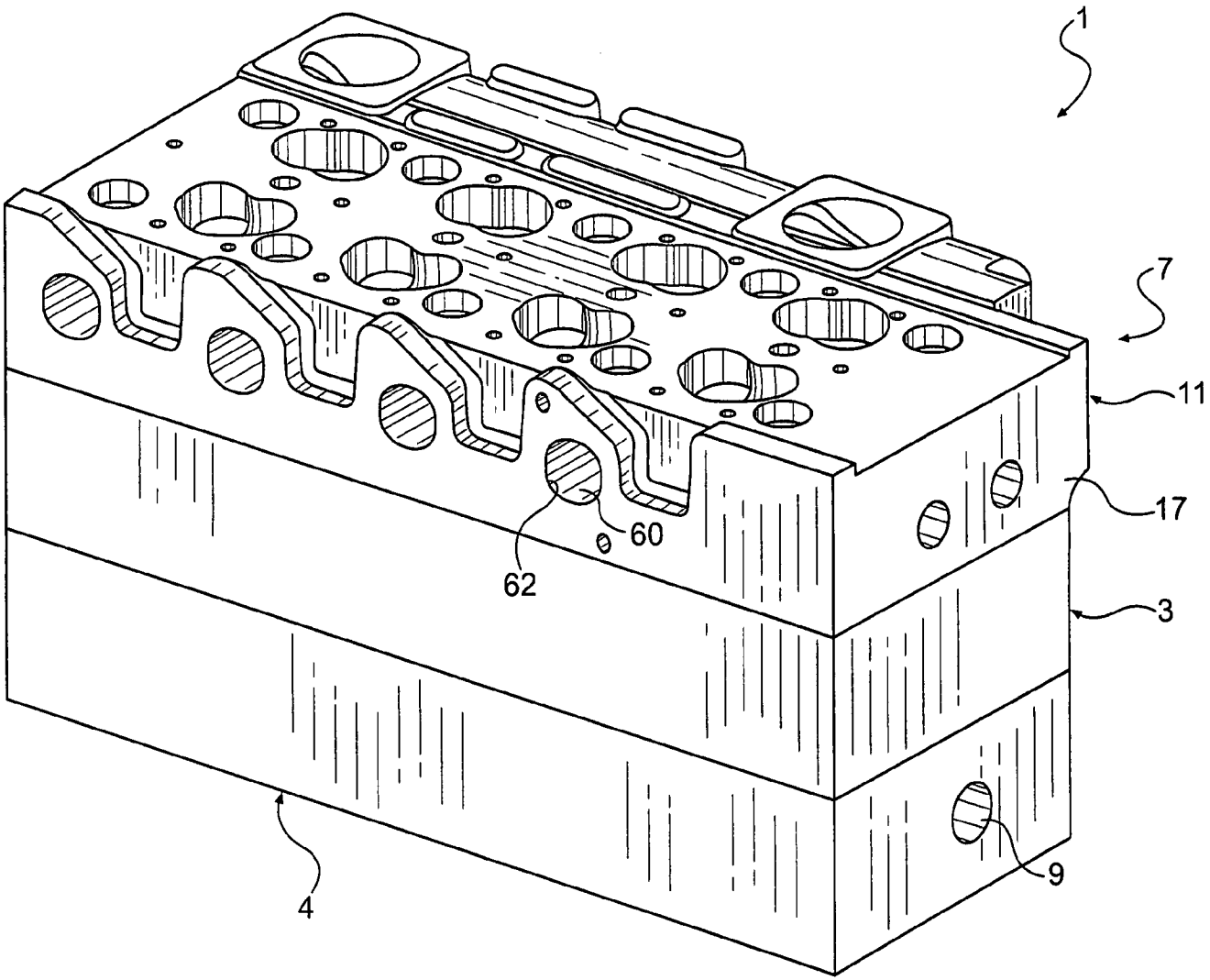
FIG. 1 is a perspective view of parts of an internal combustion engine having an exemplary cylinder head.
Figure 2:
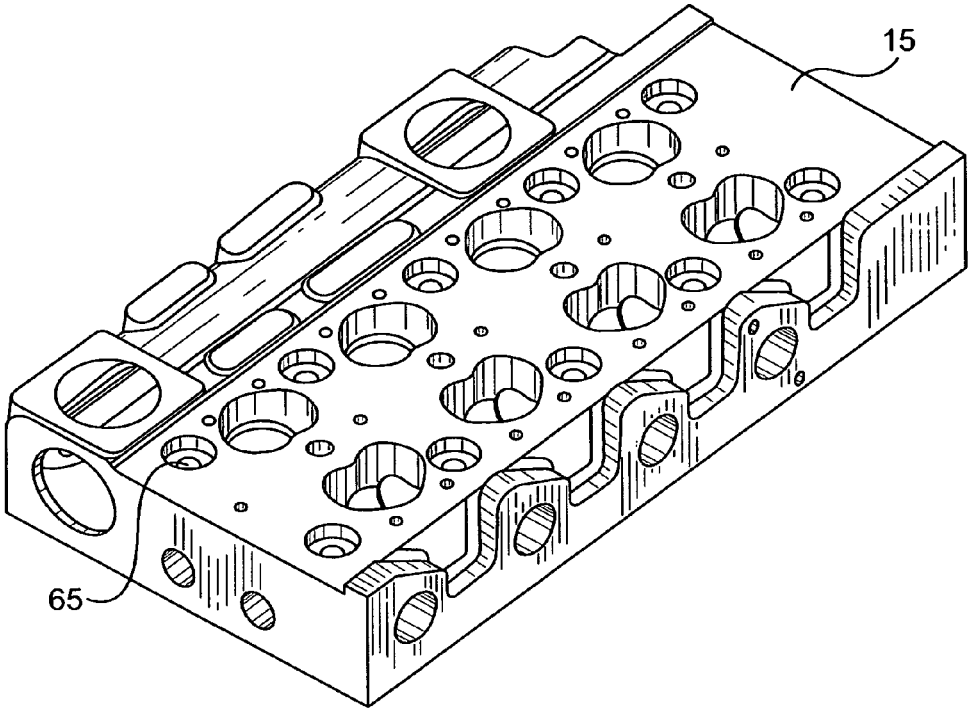
FIG. 2 is a perspective view of the cylinder head of FIG. 1.
Figure 3:
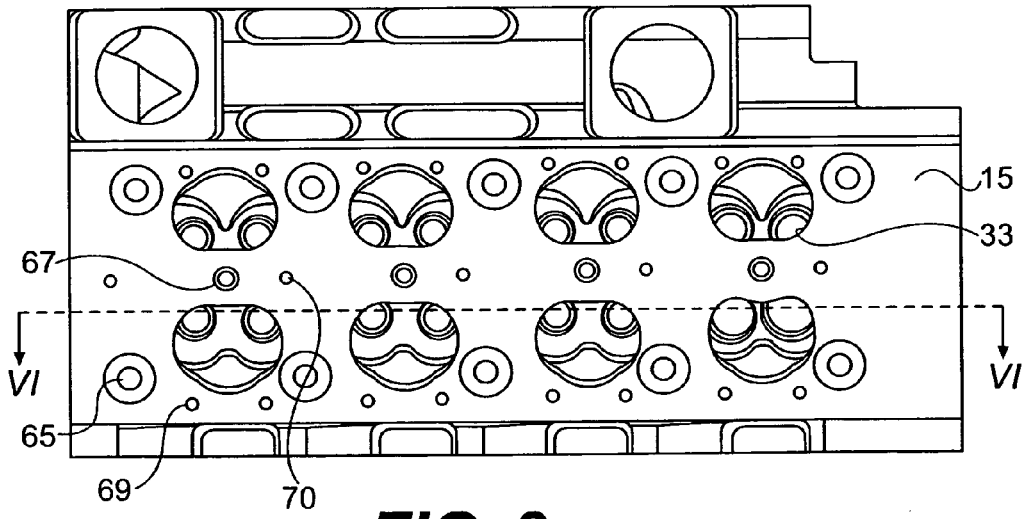
FIG. 3 is a top view of the cylinder head of FIG. 2.
Figure 4:
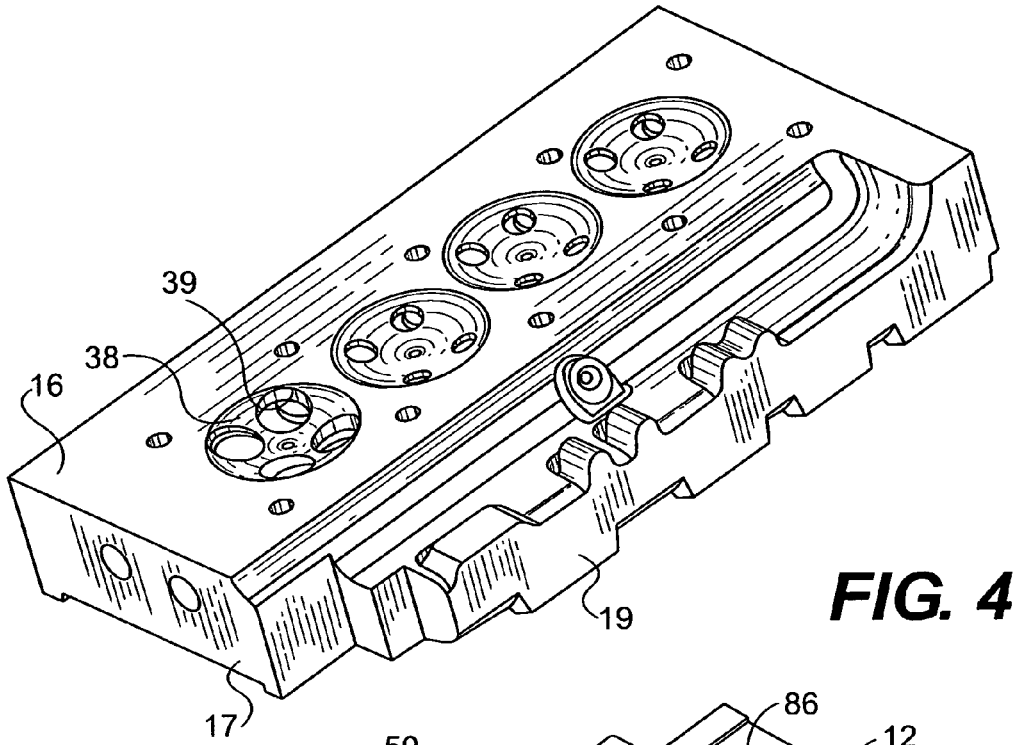
FIG. 4 is a perspective view showing the bottom of the cylinder head of FIG. 1.

In the following description, relative terms such as top, bottom, side, left, right, etc., may be used to describe certain elements. These relative terms are used for descriptive purposes only and should not be construed to limit the application. In the following, a flow area will be specified for openings and passages, etc. In these instances the term "flow area" will relate to the smallest cross sectional area of the opening, passage, etc.

Reference signs are used in the following description and drawings to describe the examples shown in the drawings. Throughout the different views and examples, the same reference signs may be used to designate similar parts.

FIG. 1 shows a perspective view of an internal combustion engine 1 in accordance with an embodiment of the application. For simplification, an engine main body 3 and crankshaft housing 4 are only schematically shown, while a cylinder head 7 of the engine 1 is shown in more detail. As one of ordinary skill would recognize, engine main body 3 may have at least one cylinder (not shown) formed therein, for accommodating a corresponding number of pistons therein. The exemplary engine main body 3 shown in FIG. 1 has four cylinders formed therein. The present application, however, is not limited to an engine having four cylinders.

The crankshaft housing 4 is adapted to accommodate a crankshaft which is coupled to the pistons as is known in the art. The crankshaft housing 4 has an opening 9 in at least one end thereof to allow part of the crankshaft to extend outside of the crankshaft housing 4.

Figure 5:
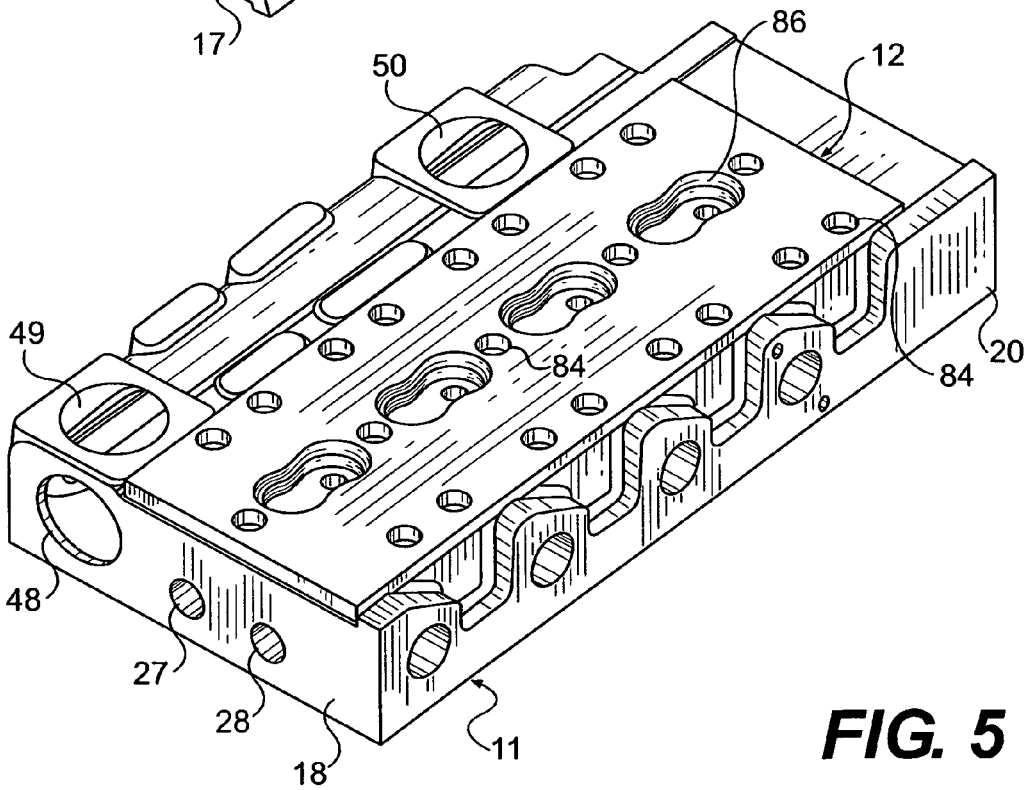
FIG. 5 is a perspective showing the top of the cylinder head of FIG. 1, having a cover plate mounted thereon.

The cylinder head 7 will now be described in more detail with respect to FIGS. 2-9 of the drawings which show an exemplary cylinder head. The cylinder head 7 includes a single piece cylinder main body 11 and a cover plate 12 which is best shown in FIG. 5. The cylinder main body 11 has a top surface 15 (best seen in FIGS. 2 and 3), a bottom surface 16 (best seen in FIG. 4), opposite end faces 17 and 18 (best seen in FIGS. 4 and 5), and opposite sides 19, 20 (best seen in FIGS. 4 and 5).

Figure 6:
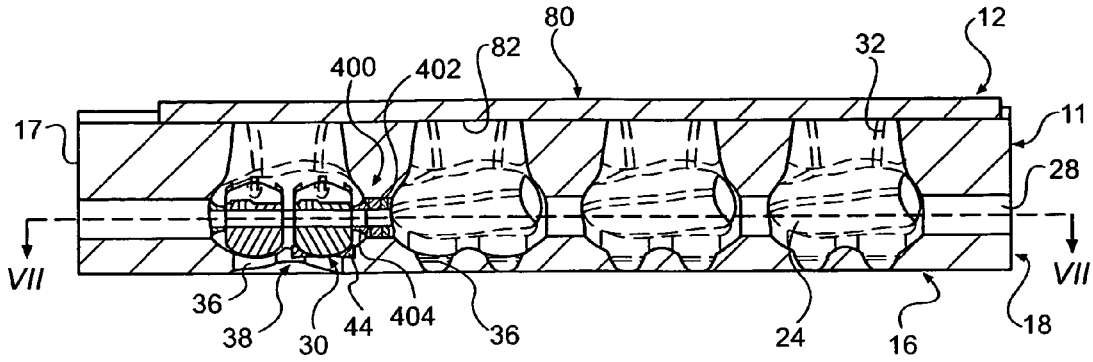
FIG. 6 is a cross-sectional view of the cylinder head along line VI-VI in FIG. 3, having additional elements mounted therein.
Figure 7:
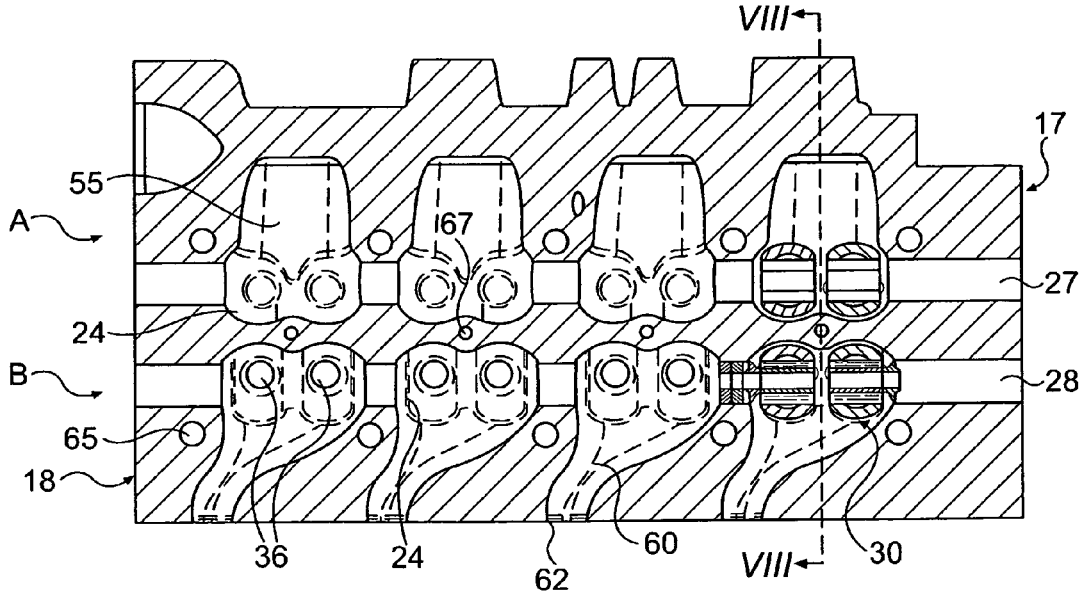
FIG. 7 is a cross-sectional view along line VII-VII in FIG. 6.
Figure 8:
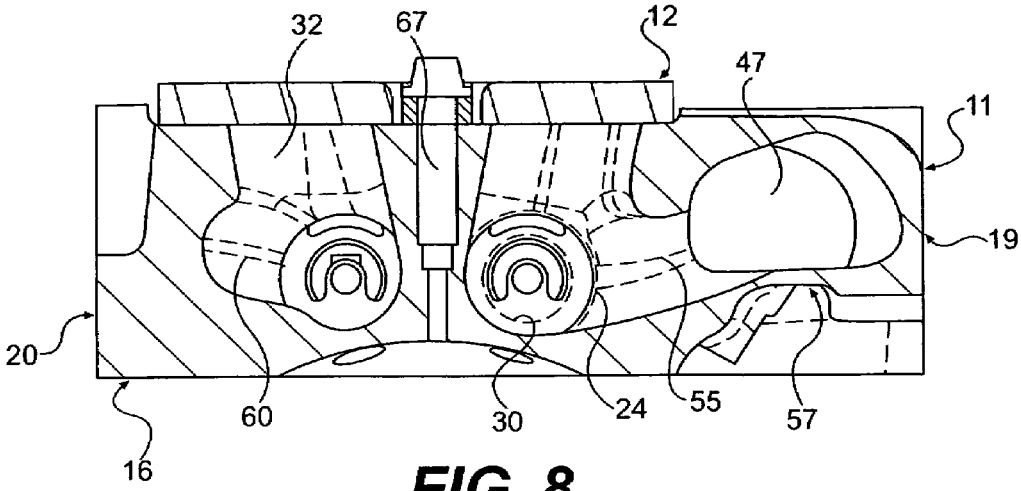
FIG. 8 is a cross-sectional view along line VIII-VIII in FIG. 7.
Figure 9:
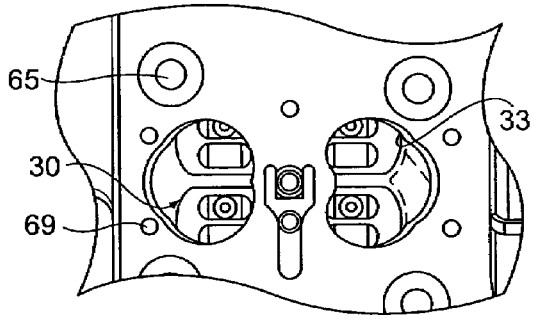
FIG. 9 is a partial top view of the cylinder head of FIG. 2, having rotary valves arranged therein.

The cylinder main body 11 has a plurality of valve chambers 24 formed therein as is best shown in the cross-sectional views of FIGS. 6-8. In particular, eight separate valve chambers 24 are provided. The valve chambers 24 are divided into two groups A and B (FIG. 7) of four valve chambers 24 each. The two groups A and B of valve chambers 24 each form a row of adjacent valve chambers 24. The valve chambers 24 of group A are air-inlet chambers and the valve chambers 24 of group B are exhaust chambers, as will become more apparent below. A bottom section of the valve chambers 24 (i.e., adjacent the bottom surface 116) is shaped to conform to the shape of the rotary valve to be received therein. Passages 27, 28 extending between the end faces 17, 18 and through the valve chambers of groups A, B, respectively, are formed in the main body 11.

As will be described in more detail herein below, each valve chamber 24 is shaped to accommodate two rotary valves 30 in a side-by-side arrangement, for example, as shown in FIG. 7.

Insertion passages 32 are provided in the cylinder main body 11 of the cylinder head 7 extending between each of the valve chambers 24 and the top surface 15. As may be best seen in FIG. 3, each of the passages 32 defines a generally heart-shaped opening 33 in the top surface 15. Each opening 33 and insertion passage 32 is sized to allow a rotary valve 30 to be inserted therethrough into the associated valve chamber 24. Each insertion passage 32 widens from its respective opening towards its respective valve chamber 24 in a longitudinal direction (see FIG. 6), but has a constant width in a direction normal to the longitudinal direction (see FIG. 8).

Flow passages 36 are provided in the main body 11 extending between each valve chamber 24 and the bottom surface 16. Two flow passages 36 are provided between each valve chamber 24 and the bottom surface 16 (one for each rotary valve to be accommodated therein). In particular, the flow passages 36 extend between the valve chambers 24 and recesses 38 formed in the bottom surface of the main body 11. In the exemplary cylinder head 7, four recesses 38 are formed. The recesses 38 are sized to correspond to the cylinders formed in the engine main body and are arranged to be aligned therewith. The recesses 38 form so-called flame faces for the cylinders in the engine main body. Each recess 38 is fluidly connected to two separate valve chambers 24, one valve chamber 24 of group A and one valve chamber 24 of group B. Each of the flow passages 36 defines an opening 39 in one of the spherical recessions 38. Each flow passage 36 tapers from its respective valve chamber 24 towards the corresponding opening 39.

In several of the figures, it can be seen that certain of the flow passages 36 and their corresponding openings 39 towards the spherical recessions 38 are of a different size to others. The reason for these different sizes being that the flow passages 36 having smaller dimensions are shown in a pre-finished state, such as a cast state. The flow passages 36, however, having larger dimensions are shown in a finished state. It should be noted that only the valve chambers 24 having the rotary valves 30 shown therein are shown in a finished state. The other valve chambers 24 (and passages 36), however, will be similar to those having the rotary valves 30 therein, once they are finished.

The insertion passages 32 and the flow passages 36 are arranged in the engine main body 11 such that there is a substantially straight line of access through the insertion passages 32 towards the flow passages 36. Circular sealing arrangements 44 are provided within each valve chamber 24 (once they are finished). The circular sealing arrangements are arranged such that they surround each opening of the passage 36 towards the valve chamber 24 and are arranged coaxially thereto. Each sealing arrangement 44 is accommodated in a corresponding seat, machined into a surface of the valve chamber surrounding each passage 36 (see FIG. 6).

A longitudinally extending air-duct 47 is provided in the exemplary main body 11. The air-duct 47 is open towards the end face 18 at opening 48. The opening 48 may be closed by a cover (not shown), when the cylinder head 7 is assembled. Passages 49 and 50 are provided which extend between the air-duct 47 and the top surface 15. The air-duct 47 extends adjacent the side 19 of the main body. In the area of the air-duct 47, the bottom surface 16 is recessed.

A flow passage 55 is provided between each valve chamber 24 of group A of the valve chambers 24 and air-duct 47. The flow area of the flow passage 55 is larger than the combined flow area of the flow passages 36 associated with the valve chamber 24 to which the flow passage 55 is connected. Also, the flow area of the air-duct 47 is larger than the flow area of the flow passage 55.

An exhaust passage 60 is provided between each valve chamber 24 of group B and the side 20 of the main body 11. Each exhaust passage 60 opens towards the side 20 of the cylinder main body 11 at a corresponding opening 62. The flow passages 60 each taper from their corresponding valve chamber 24 towards the side 20 of the main body. The flow area of the flow passage 60 at the opening 62, however, is larger than the combined flow area of the flow passages 32 associated with one of the valve chambers of group B.

The cylinder main body 11 also has mounting holes 65 extending between the top surface 15 and the bottom surface 16. At the top surface 15, the mounting holes 65 have an enlarged diameter to allow the head of a mounting bolt to be received therein.

The cylinder main body 11 also has injector passages 67 which extend between the top surface 15 and the bottom surface 16 thereof. The injector passages are each arranged to open in the center of one of the spherical recessions 38 formed in the bottom surface 16 of the main body 11. The injector passages 67 extend through a part of the main body which separates the group A of the valve chambers 24 from the group B. As is best shown in FIG. 8, the injector passage has multiple steps decreasing in diameter from the top surface 15 towards the bottom surface 16 of the main body 11. Similarly, the wall portion separating the two valve chambers 24 of groups A and B also decreases in width from the top surface 15 towards the bottom surface 16. Further, mounting holes 69 and 70 are provided in the top surface 15. The mounting holes 69 and 70 are provided with internal threads. The mounting holes 70 are arranged on a line with the injector passages 67.

The top surface 15 has a recessed main part of a rectangular shape. The recessed main part has a finished surface to allow sealing to the cover plate 12, as will be described below. The insertion openings 33, the mounting holes 65, the injector passages 67, and the mounting holes 69 and 70 are each formed in the recessed main part of the top surface 15. The top surface 15 also has a finished flat surface surrounding each of the passages 49 and 50, to allow sealing to air supply ducts, as will be described in more detail below.

The bottom surface 16 has a finished flat main surface for sealing to the engine main body. Outside of the sealing surface, the spherical recessions 38 and the recess 53 are provided.

The side 20 of the cylinder main body 11 also has finished flat surfaces, at least around the openings 62 of the flow passages 60, to allow sealing to an exhaust manifold.

The cover plate 12 is a substantially flat rectangular plate. The cover plate 12 is dimensioned to sit in the recessed main part of the top surface 15 of the main body 11. The cover plate 12 has a top surface 80 and a bottom surface 82. The bottom surface 82 is a flat finished surface, to allow sealing to the recessed main part of the top surface 15 of the main body 11. Even though not shown, a sealing arrangement may be arranged between the cover plate 12 and the cylinder head 7, when mounted thereon.

The cover plate 12 has a plurality of mounting holes 84 extending between its top surface 80 and its bottom surface 82. The number of mounting holes 84 and their arrangement corresponds to the number and arrangement of mounting holes 69 and 70 formed in the top surface 15 of the main body 11. The cover plate 12 also has openings 86 extending between the top and bottom surface thereof. The openings 86 are sized to accommodate part of an injector arrangement (not shown) therein. The openings 86 are arranged such that they are aligned with the injector passages 67 in the main body 11, when the cover plate 12 is mounted thereon.

Having described above an exemplary cylinder head 7, it should be noted that the application is not limited to the specific cylinder head configuration. In particular, as mentioned above, the valve chamber 24 is shaped to receive two rotary valves 30 therein. The valve chamber 24, however, may be shaped to receive a single rotary valve or a larger number than two rotary valves 30 therein. Furthermore, if two or more rotary valves 30 are used, these do not necessarily have to be arranged in a side-by-side arrangement as shown.

Independent of the number of rotary valves 30 per valve chamber 24, the several passages arranged within the cylinder head 7 may remain the same. Only the number of flow passages 36 might be adapted. Furthermore, the cylinder head 7 as shown is configured to serve four cylinders of an internal combustion engine. The cylinder head 7 may, however, be adapted to serve any number of cylinders. Especially in large engine applications, one cylinder head may be provided per cylinder of the engine.

Even though the cylinder main body 11 of the cylinder head 7 is shown as a single piece cylinder main body 11 having valve chambers 24 formed therein, the cylinder main body 11 could include two or more body parts, such as an upper and a lower body part, which when assembled form the valve chambers 24 and the respective flow passages. In such a split design, the insertion openings 32 may be dispensed, as cylinders may be inserted into the valve chambers 24 before assembly of the body parts. For the same reason, the cover plate 12 could be dispensed.

Where the cover plate 12 is used to cover the insertion openings 32 in the cylinder head 7, the surface of the cover plate 12 facing to the cylinder head 7 may not be flat. It may rather have one or more projections dimensioned to fit into the insertion passages 32 to at least partially fill those. A part from such projections, the surface of the cover plate 12 facing the cylinder head 7 may again be a flat finished sealing surface.

Though not shown, cooling fluid passages may be arranged within the cylinder head main body 11 of the cylinder head 7. In particular, a cooling fluid passage may be provided within an elevated wall portion between adjacent flow passages 36, adjacent each valve chamber 24, and in particular circumferentially around the longitudinally extending passages 27 and 28. In the one-piece design of the cylinder main body 11 cooling fluid passages may extend substantially from the bottom to the top of the one piece cylinder head main body 11.

In the example shown in FIG. 7, longitudinal passages 27, 28 are provided in the cylinder head 7. It would also be possible to provide passages extending transverse in the valve body to accommodate a drive shaft therethrough. In such a case, the drive shaft would extend from the side portions of the cylinder head 7. The valve chamber 24 may be adapted accordingly and possibly the location of some of the flow passages also may be adapted. Having passages for accommodating drive shafts extending transverse to the valve body may be an option in a cylinder head configured for a single cylinder.

Figure 10:
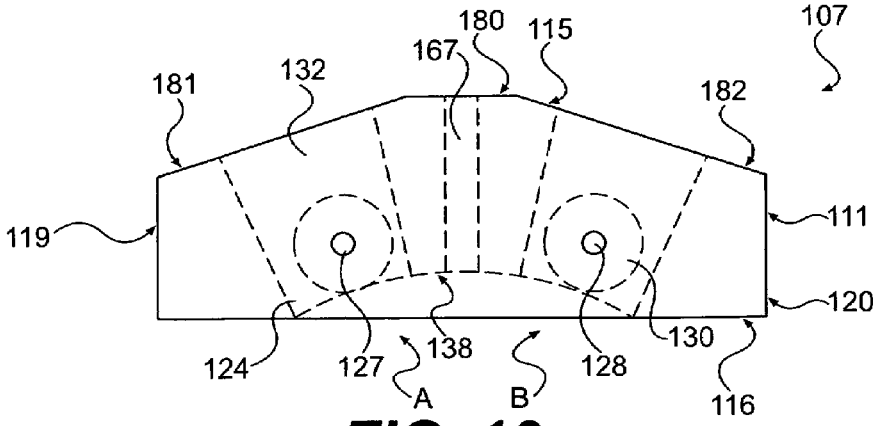
FIG. 10 is an end view of an alternative cylinder head.

FIG. 10 shows schematically an end view of another exemplary cylinder head 107. The cylinder head 107 has a cylinder head main body 111 having a top surface 115, a bottom surface 116, end faces (only one of which is shown), and sides 119 and 120. Valve chambers 124 are provided within the cylinder head main body 111. The valve chamber 24 may be of substantially the same shape as in the cylinder head 7 described above. The valve chamber 124 and other internal parts of the cylinder head main body 111, which will be described herein below, are indicated by broken lines.

Longitudinal passages 127 and 128 extend between the end faces of the cylinder head main body 111. The passages 127, 128 are again arranged to extend through separate groups A, B of valve chambers 124. Rotary valves 130 are schematically indicated, to be received in the valve chambers 124. Passages 132 are provided in the cylinder head main body 111 extending between each of the valve chamber 124 and the top surface 115. The bottom surface 116 again has recessions 138 and flow openings between the individual valve chamber 124 and the recessions 138 are provided as in the cylinder head 7, described with respect to FIGS. 1-9. An injector passage 67 is also provided between each recession 138 in the bottom surface 116 and the top surface 115.

One major difference between the cylinder head 107 and the cylinder head 7 described before is that no additional flow passages such as the flow passages 47, 55, and 60 are provided. Fluid flow into or out of the respective valve chamber 124 is provided via the passage 132 which is a combined insertion/flow passage. Furthermore, the shape of the top surface 115 differs from the shape of the top surface 15 described before.

The top surface 115 of the cylinder head main body 111 has a longitudinally extending central portion 180 which is horizontally arranged. A part 181 of the top surface 115 is angled with respect to the central part 180 and extends between the central part 180 and the side 119. A further part 182 of the top surface 115 is also angled with respect to the central part 180 and extends between the central part 180 and the side 120.

Passages 132 extending from valve chambers 124 of group A open towards part 181 of the top surface 115. Passages 132 extending from valve chambers 124 of group B open towards part 182 of the top surface 115. The passages 132 have a main extension which is substantially at right angles to its respective part 181, 182. The parts 181 and 182 of the top surface 115 are angled with the same angle with respect to the central part 180. The part 181 is arranged with respect to the spherical recession 138 in the bottom surface 116, such that a plane parallel to the part 181 may be tangential to the spherical recession 138 in the area of the valve chamber. The same is true for part 182.

The cylinder head 107 may thus be formed symmetrical with respect to a longitudinal plane extending normal and through the center of part 180 of the top surface 115. The parts 181 and 182 are each substantially flat and are finished in order to allow a sealing to respective flow manifolds (not shown) to be mounted thereon and sealed therewith. Respective mounting holes (not shown) are provided in each of the parts 181 and 182 of the top surface 115.

Even though the top surface 115 described above has a central part and two angled parts, it would be possible to dispense with the central part 180 and just to have two angled parts. The angled parts would be angled with respect to each other and with respect to the bottom surface of the cylinder head 107. An angle included between angled part 181 or angled part 182 is for example in a range between 20 to 50 degrees or in a range between 30 to 40 degrees.

As mentioned above, each of the valve chambers 24 or 124 of the cylinder head 7 or 107 is shaped to accommodate two rotary valves 30 therein, but may also be shaped to accommodate a single rotary valve or more than two.

An exemplary rotary valve 30 will now be described in more detail with reference to FIGS. 11-16. The rotary valve 30 according to the embodiment shown in FIGS. 11-16 has a body 202 which is made, for example, of a metal, a ceramic or a combination thereof, in the shape of a spherical segment. The body has a spherical zone 204 and two parallel, generally flat side portions 206 and 208. The side portions 206, 208 are equidistant from a midpoint of the spherical zone 204.

The spherical zone 204 is generally rotationally symmetric with respect to an axis of rotation of the rotary valve 30. Any openings provided in the spherical zone 204 are not considered to break this rotational symmetry even if these openings are not arranged in a rotationally symmetric manner. As used herein, if reference is made to a rotational symmetry of an element or a portion thereof, the rotational symmetry refers to the element or portion in general, disregarding any openings formed in that element or portion, which may break the rotational symmetry.

A straight passage 210 is formed through the body 202 between the side portions 206 and 208. The passage 210 is co-axial to a central axis extending between the two side portions 206, 208, which defines the axis of rotation for the rotary valve 30. The passage 210 is dimensioned to allow a drive shaft to be inserted therethrough, as will be described in more detail herein below.

The body 202 also has a chamber 212 formed therein. The chamber 212 is open towards both side portions 206, 208 at respective openings 216, 218. The openings 216, 218 are of the same shape and dimensions and, as can be best seen in FIG. 15, each of the openings 216, 218 has approximately a C-shape, partially surrounding the central passage 210. Each openings 216, 218 may extend more than 180° in a direction of rotation of the rotary valve 30.

Furthermore in the embodiment as shown, openings 226 and 228 are provided in the spherical zone 204 to open the chamber 212 towards the spherical zone 204. The two openings 226, 228 are arranged in a side-by-side arrangement and are symmetrical with respect to a plane extending through the midpoint of the spherical zone and being parallel to both side portions 206, 208. A web 230 is formed between the openings 226, 228. The openings 226, 228 are centered with respect to the chamber 212 in a rotational direction of the rotary valve body, i.e., in circumferential direction. Openings 226, 228 each widen in a direction away from the plane, which is parallel to the side portions 206, 208. Furthermore, each of openings 226, 228 define a curved, concave leading edge 232 and a curved concave trailing edge 233 with respect to a direction of rotation of the valve. The shape of the concave leading edge 232 and the concave trailing edge 233 conforms to a circumferential shape of a flow passage formed in a cylinder head 107, i.e. if the flow passage is round, the leading edge will have a round shape.

A cross-sectional flow area of the opening 216 in the side portion 206 is equal to or larger than a cross-sectional flow area of the opening 226. Similarly, a cross-sectional flow area of the opening 218 is equal to or larger than a cross-sectional flow area of the opening 228. The chamber 212 defines a fluid connection between the openings 216, 218 in the side portions and the openings 226, 228 in the spherical zone.

A wall portion of the valve body 202 separating the passage 210 from the chamber 212 has an opening 238 formed therethrough. The opening 238 is aligned and centered with respect to opening 228 in the spherical zone 204. The wall portion 234 has a raised section 240 extending into the chamber 212 and surrounding the opening 238. The raised section 240 defines a flat surface 242. A similar mounting hole may be provided aligned and centered with respect to opening 226.

The rotary valve 30 shown in FIGS. 11-16 has two side-by-side openings in the spherical zone 204 thereof. It should be noted, that a single opening (e.g., without the web 230) or a larger number of openings (i.e., more than two), may be provided in the spherical zone. Furthermore, the chamber 212, as shown, is open at both side portions 206, 208. Again it should be noted that the chamber 212 might only be open to one of the side portions. It is also possible to provide a separating wall in the chamber 212 to provide two separate chambers, each connected to one of the side portions 206, 208 and one of the openings 226, 228 in the spherical zone 204. Indeed, any type of fluid connection between the openings 216, 218 in the side portions 206, 208 and the openings 226, 228 in the spherical zone 204, such as a straight passage may be provided in the valve body 202. Although the openings 226, 228 in the spherical zone 204 are symmetrical with respect to a plane parallel to the side portions 206, 208 as shown, it is possible to offset the two openings in a direction of rotation of the rotary valve or to have openings of different shapes and sizes. An annular protrusion may be provided around the central passage to extend the passage beyond the otherwise flat side portions 206, 208.

The rotary valve 30 was described as having a spherical zone 204, which is rotationally symmetric with respect to the axis of rotation of the rotary valve 30. Rather than having a spherical zone 204, it is possible to provide a generally curved portion, which is rotationally symmetric with respect to the axis of rotation of the rotary valve 30. In other words, the curvature of the surface extending between two side portions in the direction of rotation may differ from the curvature perpendicular to the direction of rotation. The curvature perpendicular to the direction of rotation may be circular or may deviate therefrom, for example, an oval curvature. Although a convex (spherical) curvature is shown in the drawings, a concave curvature or a mixture of concave and convex curvatures is possible. The curvature may be symmetric with respect to a plane which is parallel to the side portions and bisects the rotary valve, but it is also possible to have a non-symmetrical curvature.

Figure 11:
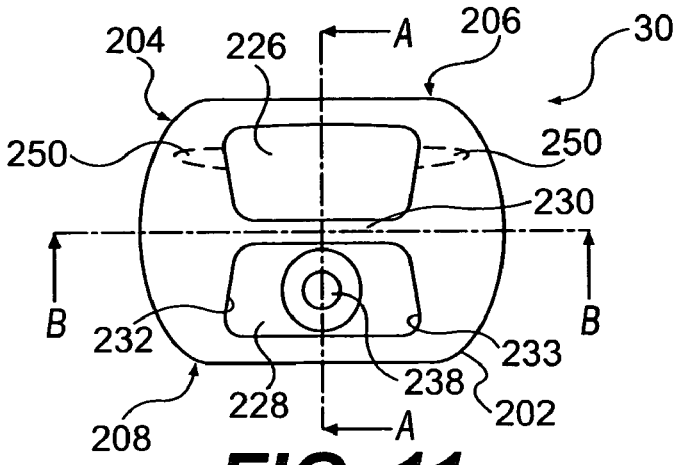
FIG. 11 is a top view of an exemplary rotary valve to be used in a cylinder head of an internal combustion engine.
Figure 12:
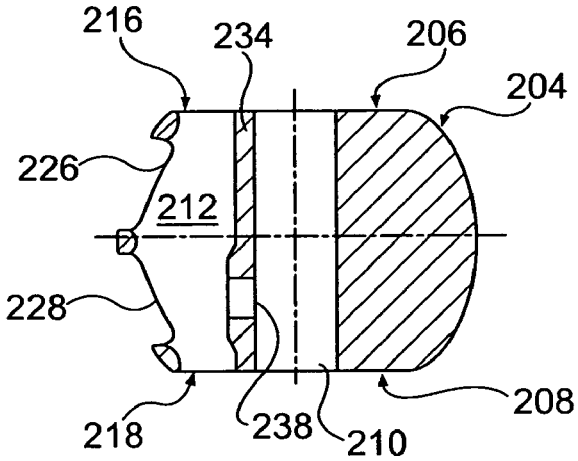
FIG. 12 is a cross-sectional view of the rotary valve along line B-B in FIG. 11.
Figure 13:
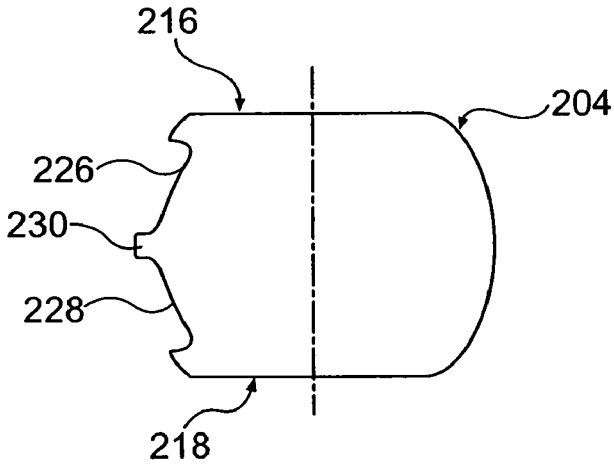
FIG. 13 is a side view of the rotary valve of FIG. 11.
Figure 14:
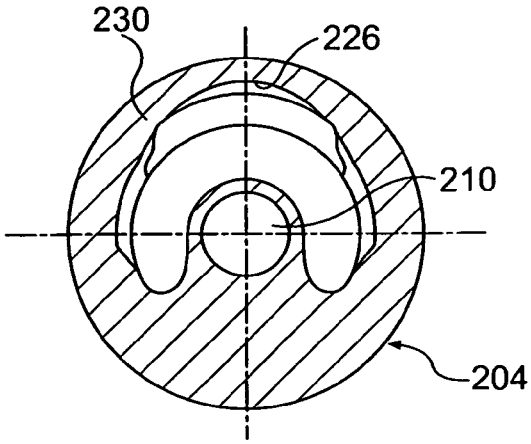
FIG. 14 is a cross-sectional view of the rotary valve along line A-A in FIG. 11.
Figure 15:
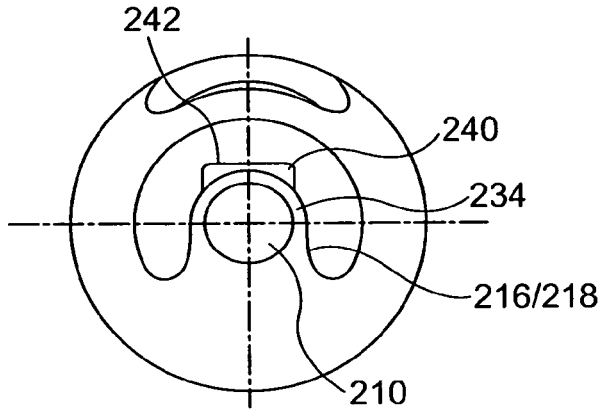
FIG. 15 is another side view of the rotary valve of FIG. 11.
Figure 16:
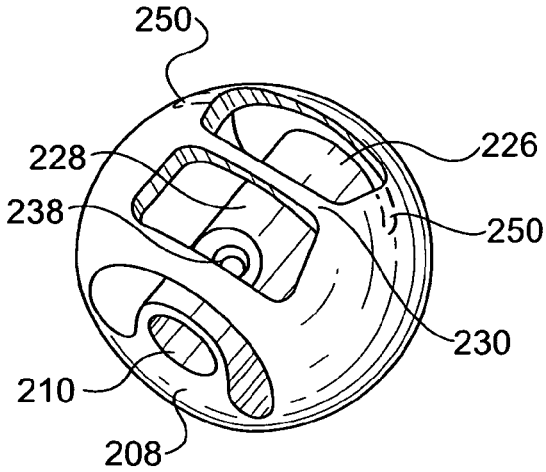
FIG. 16 is perspective view of the rotary valve of FIG. 11.

As indicated by a broken line in FIGS. 11 and 16, opening 226 (and/or 228) may have a part 250 which extends beyond at least one of the leading edge 232 and the trailing edge 233. This part 250 may be seen as a secondary part of the openings 226, 228. This secondary part would have a cross-sectional flow area which is substantially smaller than the flow area of the rest of the opening. The part 250 would, for example, have a flow area which is less than 50 percent of the flow area of the other part of the openings 226 and 228.

The interior surfaces of the chamber 212 and/or of the flow passages or openings 260, 276, 278 in the rotary valve may be made of a heat insulative material. In particular, a coating may be provided on these surfaces. Additionally, heat insulative material may be provided on any surface of the rotary valve, including the central passage. The whole deflector may indeed be made of a heat insulative material.

Figure 17:
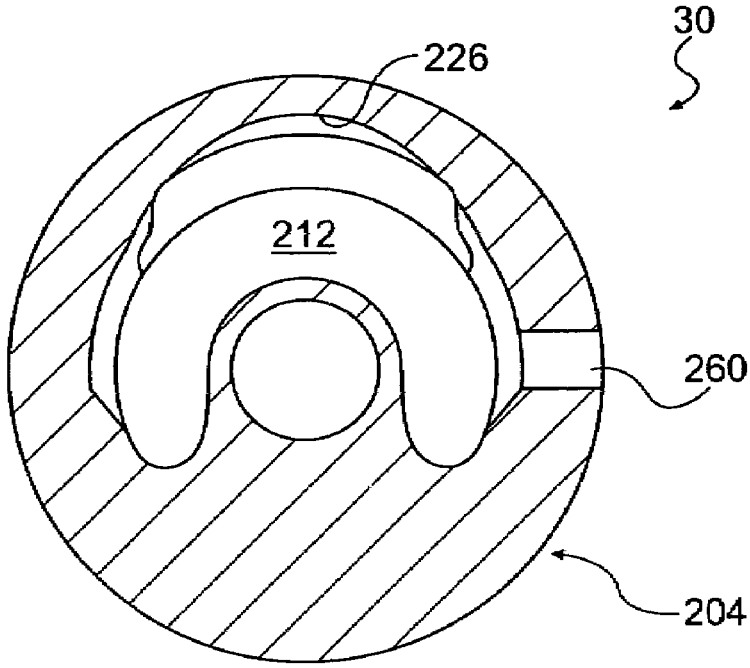
FIG. 17 is cross-sectional view similar to FIG. 14 of an alternative rotary valve.

FIG. 17 shows a cross-sectional view (similar to FIG. 14) of an alternative rotary valve 30. The rotary valve 30 shown in FIG. 17 has all the features of the rotary valve 30 described with respect to FIGS. 11-16. The only difference is that an additional opening 260 extending between the chamber 212 and the spherical zone 204 is provided. The additional opening 260 is rotationally offset with respect to the openings 226, 228. The flow area of the additional opening 260 is smaller than the combined flow area of the openings 226, 228. Rather than providing a single additional opening 260 between the chamber 212 and the spherical zone, several additional openings 260 may be provided. These can be in a side-by-side arrangement similar to the openings 226, 228 or they can be rotationally offset. The combined flow areas of the openings 260 are smaller than the combined flow areas of openings 226, 228. The openings 226, 228 and 260 may be seen as a set of openings. In an alternative rotary valve, a second set of these openings which is rotationally offset by 180° may be provided. In this case, the chamber 212 would have to be adapted accordingly.

Figure 18:
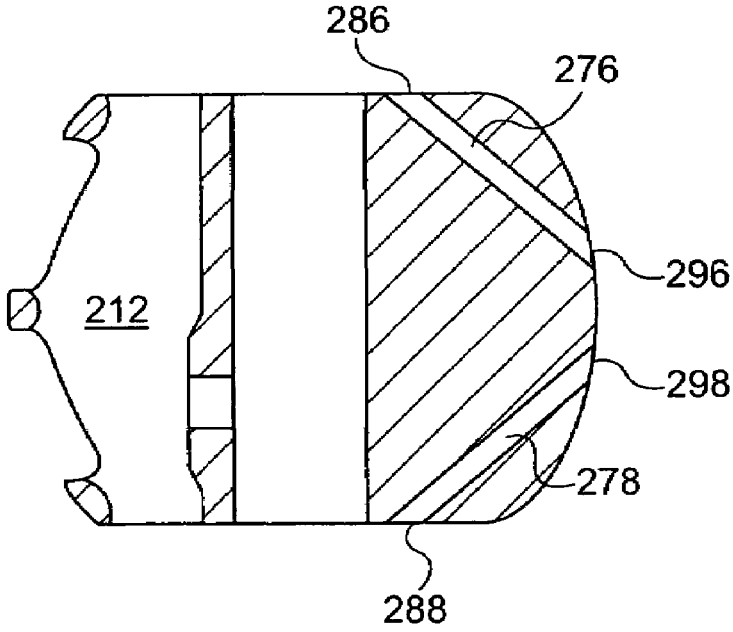
FIG. 18 is cross-sectional view similar to FIG. 12 of an alternative rotary valve.

FIG. 18 shows a cross-sectional view (similar to FIG. 12) of yet another exemplary rotary valve 30. The rotary valve 30 shown in FIG. 18 has substantially the same features as the rotary valve 30 described with respect to FIGS. 11-16. The rotary valve 30 according to FIG. 18, however, differs from the rotary valve 30 shown in FIGS. 11-16 by having additional flow passages 276 and 278 formed in the body 202 thereof. The flow passages 276, 278 extend between the spherical zone 204 and the side portions 206, 208 respectively and define respective openings 296, 298, 286, and 288. The flow passages are each angled with respect to the side portions 206, 208.

Even though FIG. 18 shows the flow passages 276, 278 being symmetric with respect to a plane, which is parallel to the side portions 206, 208 and bisects the rotary valve, they may be asymmetric. Rather than having two flow passages 278, 288, a single flow passage may be provided. Furthermore, a larger number of flow passages may be provided, which may be symmetrically paired, like the ones in the drawings, or which may be asymmetric such as offset with respect to the direction of rotation of the rotary valve.

Figure 19:
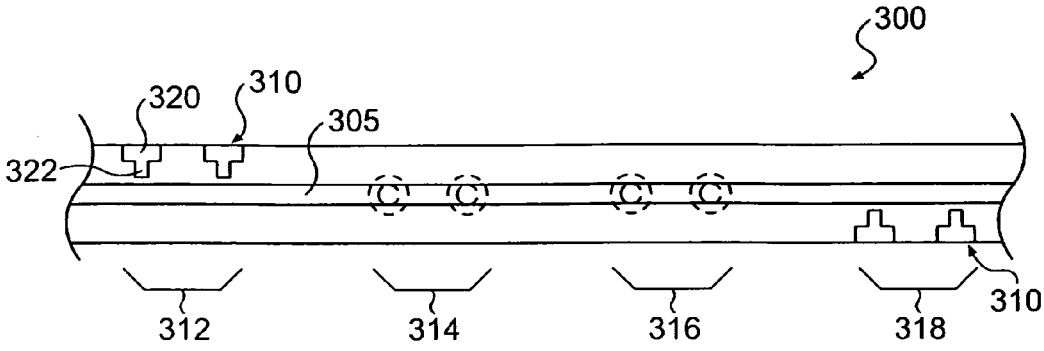
FIG. 19 is cross-sectional view of a drive shaft for rotating rotary valves.

FIG. 19 shows a schematic longitudinal cross-sectional view of a drive shaft 300 for rotating rotary valves mounted thereon. The drive shaft 300 is, for example, suitable to be used with the cylinder head 7 and the rotary valves 30, as described above, and reference may be made thereto. The drive shaft 300 is dimensioned to pass through the passages 27, 28 of cylinder head 7 and any bearing elements provided therein. The drive shaft 300 is made of metal, ceramic, or any other suitable material.

The drive shaft 300 has a central flow passage 305 extending longitudinally therethrough, which may be connected to a cooling fluid supply (not shown). Especially in the case of a drive shaft made of ceramic, the flow passage may be dispensed with. The drive shaft 300 has a plurality of mounting holes 310 formed therein, each mounting hole being provided for mounting of a rotary valve to the drive shaft 300, as will be explained in more detail herein below. The mounting holes 310 are spaced in a longitudinal direction. As shown in FIG. 19, the exemplary drive shaft 300 has eight mounting holes 310 formed therein. The first two mounting holes 310 on the left hand side of the drive shaft 300 are formed in the same angular position with respect to the rotational direction of the drive shaft 300. The first two mounting holes 310 form a first group 312 of mounting holes 310.

The third and fourth mounting holes 310 form a second group 314, the fifth and sixth mounting holes 310 (which are indicated by a broken line) form a third group 316 and the seventh and eighth mounting holes 310 (which are indicated by a broken line) form a forth group 318. The mounting holes 310 are rotationally aligned within in each group 312 to 318, but rotationally offset with respect to the mounting holes of the other groups. In the example shown in FIG. 19, each group 312 to 318 is rotationally offset by 90° with respect to two of the other groups and 180° with respect to one of the groups. The centers of the mounting holes 310 in each of the groups are spaced with a distance corresponding to the distance between adjacent flow passages 36 in the above described valve chambers 24. Adjacent mounting holes of adjacent groups are spaced with a distance corresponding to the distance between adjacent flow passages 36 of adjacent valve chambers 24.

The mounting holes 310 are stepped holes having an outer portion 320 and an inner portion 322. The outer portion 320 has a larger diameter than the inner portion 322. The inner portion 322 has an internal thread. Although the drive shaft 30 was described for use with the specific cylinder head and the rotary valves shown above, the number of mounting holes and their relative positions may vary in different applications. Depending on the application, more than two mounting holes 310 may be provided in each group, for example, when more rotary valves are to be grouped together per group or when more than one mounting hole is used to mount a rotary valve on the drive shaft. The rotary valves may be rotationally aligned within the groups or rotationally offset with a predetermined angle.

Figure 20:
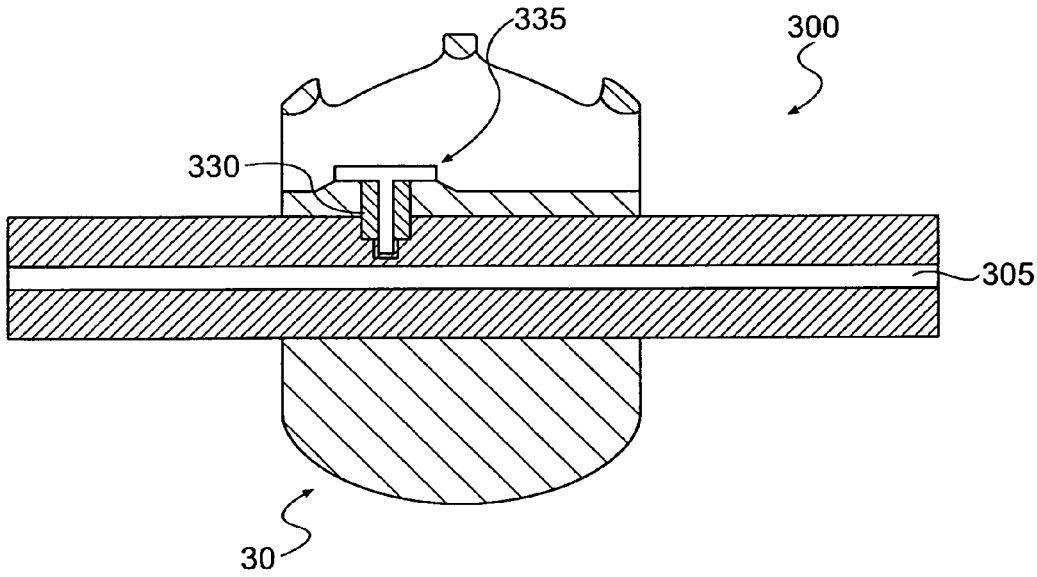
FIG. 20 is an enlarged cross-sectional view of a section of the drive shaft according to FIG. 19, having a rotary valve mounted thereon.

FIG. 20 shows an enlarged sectional view of a rotary valve 30 as described with respect to FIGS. 11-16 mounted onto the drive shaft 300. As can be seen in FIG. 20, a ring dowel 330 is provided, extending into the opening 238 of the rotary valve 30 and into the outer portion 320 of the mounting hole 310 in the drive shaft 300. The ring dowel may be made from metal or any material which is strong enough to withstand the stress applied thereto. Furthermore, a screw 335 having a head and a shaft is provided. The shaft extends through the ring dowel 330 into the inner part 322 of the mounting hole 310 where external threads on the shaft come into engagement with the inner threads provided in part 322 of mounting hole 310. The lower part of the head of the screw 335 is in engagement with the flat surface 242 of the raised section 240 of the rotary valve 30.

Figure 21A:
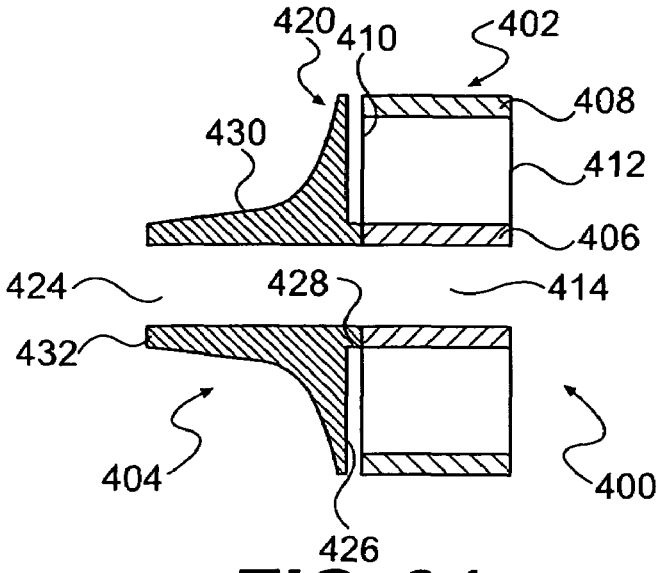
FIG. 21(*a*) is a cross-sectional view of a deflector/bearing assembly.
Figure 21B:
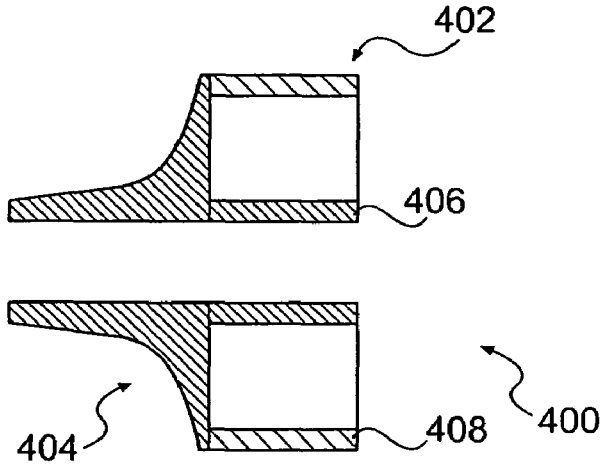

FIGS. 21(*a*) and (*b*) show different examples of a deflector/bearing assembly 400 to be arranged within the cylinder head 7 as, for example, shown in FIG. 6 and reference may be made thereto. The deflector/bearing assembly 400 has a bearing part 402 and a deflector part 404. The bearing part 402 is formed by an inner race 406, an outer race 408, and a plurality of bearing elements interposed therebetween, such as rollers or balls. Also, any other type of bearing element may be used. Lubrication in the form of a lubricant is provided for the bearing elements and end plates 410 and 412 are provided to seal the lubricant into the bearing part 402. The inner and outer race 406, 408 and/or bearing part 402 may have a surface made of a solid lubricant, in which case sealing of a viscous lubricant is not required. The inner race 406 has a central opening 414 dimensioned to accommodate the drive shaft 300 therein.

The deflector part 404 is formed of a one piece deflector body 420. The deflector body 420 has a central opening 424 extending longitudinally therethrough. The central opening 424 is dimensioned to accommodate the drive shaft 300 therein. The deflector body 402 is rotationally symmetrical with respect to a central axis of the central opening 424. The deflector body 402 has a diameter which is approximately equal to or larger than a diameter of one of the passages 27, 28 formed in the cylinder head 7.

The deflector body 420 has a substantially flat surface 426 facing the bearing part 402. A deviation from the flat surface is an annular projection surrounding the central opening 424. The annular projection 428 is dimensioned to come into engagement with the inner race 406 of the bearing part 402. When the annular projection 428 is in engagement with the inner race 406, the flat surface 426 is spaced from the rest of the bearing part 402.

The deflector body 420 also defines a deflecting surface 430 facing away from the flat surface 426. The deflecting surface 430 decreases in diameter in a direction away from the flat surface 426 and defines a curve. At the end of the deflector body 420, which is opposite to the annular projection 428, a flat abutment surface 432 is formed for engagement with a part of the rotary valve 30 surrounding the passage 210, for example, as shown in FIG. 6.

In FIG. 21 (*a*), the deflector body and the inner race are shown to be separate parts. As shown in FIG. 21 (*b*) the deflector body 420 and the inner race 406 may be formed as a single piece. Although FIG. 21 (*a*) shows the deflector part and the bearing as an assembly, it should be noted that the deflector part and the bearing may indeed be used independently from each other, i.e. a deflector part as shown and described may be used as a deflector independently of the presence of a bearing part and vice versa. The bearing part may, for example, be dispensed with if a rotary shaft (such as drive shaft 300) and a passage (such as passage 27 or 28) are configured to have complementary bearing surfaces formed thereon. Such complementary bearing surfaces could, for example, be surfaces made of a solid lubricant. In such an arrangement at least one of a surface of the drive shaft and an inner wall surface of the passage should be made of a solid lubricant.

The deflecting surface 430 may be a smooth curving surface, as shown, or it may, for example, have guide grooves arranged therein. It is also possible that blades are provided on the deflector in lieu of or in combination with the deflecting surface. Such blades may be configured to facilitate changing a longitudinal fluid flow (with respect to the deflector) to a radial flow or vice versa, in particular upon rotation thereof. The deflecting surface and optionally the other surfaces of the deflector may be made of a heat insulative material. The deflector body as a whole may be made of a heat insulative material or may, for example, be made of metal at least partially coated with a heat insulative material.

Figure 22:
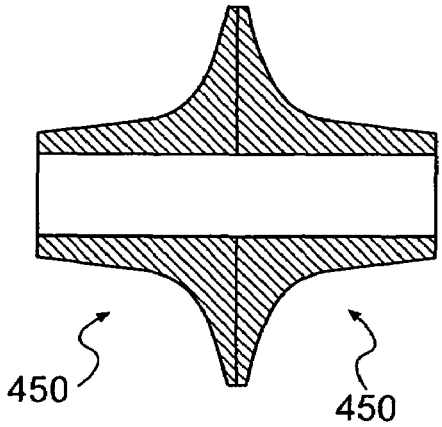
FIG. 22 is a cross-sectional view of a deflector assembly.

FIG. 22 shows an assembly of two deflectors, which may each be substantially of the same shape and dimensions as the deflector part 404 shown in FIG. 21 (*a*). The main difference is, however, that the annular projection 428 is dispensed with so that the deflectors 450 can be arranged in a back-to-back relation as shown in FIG. 22 without forming a space therebetween. Such an assembly of deflectors may, for example, be used in combination with the cylinder head arrangement shown in FIG. 6, where the assembly would be arranged between adjacent rotary valves 30 in the same valve chamber 24. Although the deflectors 450 are shown as separate parts, they may be integrally formed, to form a deflector having oppositely facing deflector surfaces.

Figure 23:
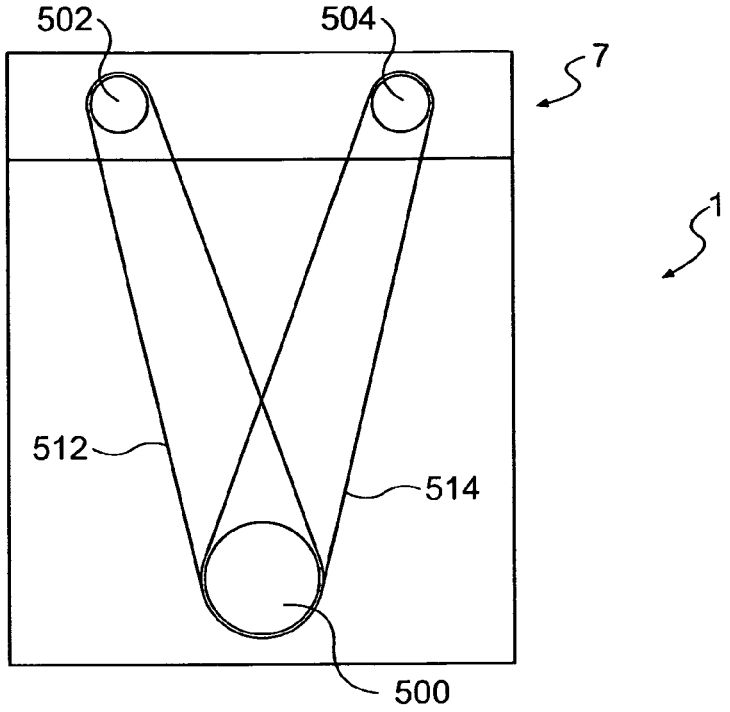
FIG. 23 is a schematic end view of an internal combustion engine showing a drive mechanism for driving rotary valves arranged in the cylinder head of the internal combustion engine.

FIG. 23 shows a schematic end view of an exemplary internal combustion engine 1, such as the one previously described. In particular, FIG. 23 schematically shows a drive mechanism for driving rotary valves arranged in the cylinder head 7 thereof. Reference numeral 500 indicates a crankshaft 500. Reference numerals 502 and 504 indicate a drive shaft, such as a drive shaft 300 described above and arranged in the cylinder head 7.

Drive elements 512 and 514, such as, for example, belts, chains, toothed belts, etc., are entrained about the crankshaft 500 and the drive shafts 502, 504 respectively. Rotation of the crankshaft 500 is thereby transmitted to the drive shafts 502, 504, respectively. Though not shown, a reduction mechanism may be provided in order to ensure that one rotation of the crankshaft translates into half a rotation of each of the drive shafts 502, 504. Rather than having drive belts directly entrained about the crankshaft 500 and the drive shafts 502, 504, pulleys may be coupled to these members, and the drive belts may extend around the pulleys. Also, a gear mechanism having, for example circular gears may be used to transmit rotation of the crankshaft 500 to the drive shafts 502, 504.

Figure 24A:
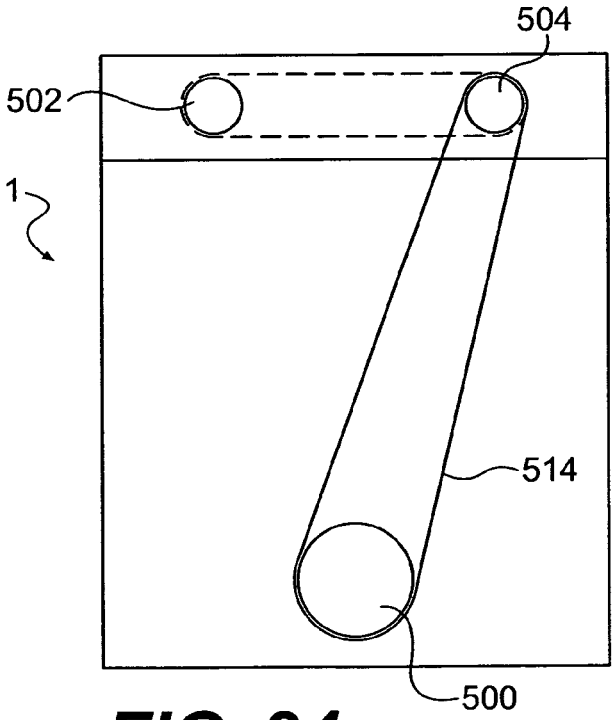
FIG. 24(*a*) is an end view of an internal combustion engine.
Figure 24B:
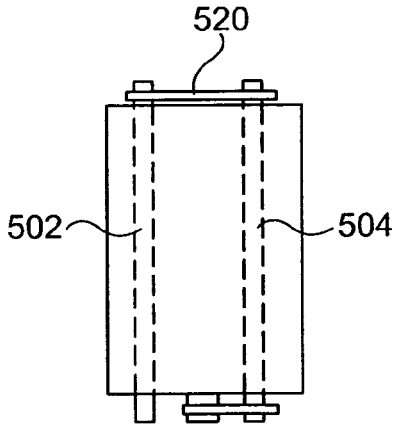

FIG. 24(*a*) shows a schematic end view of an alternative internal combustion engine, and FIG. 24(*b*) shows a schematic top view thereof. The internal combustion engine may be the same as the one described above with respect to FIG. 1. The drive mechanism, however, differs with respect to the previously described drive mechanism. In the drive mechanism according to FIG. 23, the drive shafts 502, 504 was directly coupled by a corresponding drive elements 512, 514 to each of the drive shafts 502, 504. In the Example, as shown in FIGS. 24(*a*) and 24(*b*), however, the crankshaft 500 is only directly coupled to drive shaft 504 via the drive element 514. A separate drive element 520 is provided which is entrained about the drive shafts 502 and 504 to transmit rotation of drive shaft 504 to drive shaft 502. The crankshaft 500 is thus rotatably coupled to the drive shaft 502 via the drive shaft 504 and the drive elements 514, 520. The drive elements 514 and 520 are provided at opposite ends of the drive shaft 504.

Figure 25:
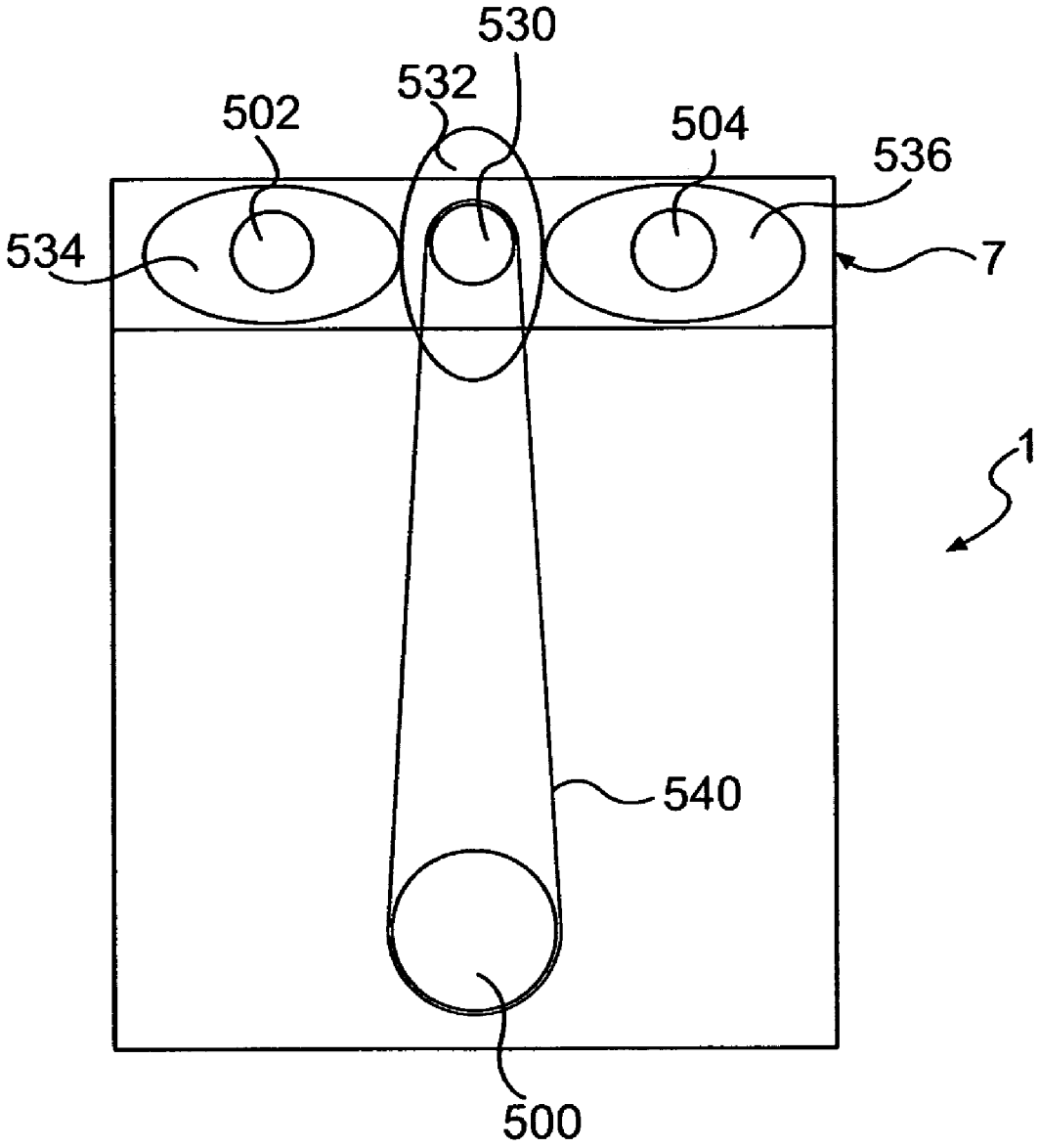
FIG. 25 is an end view of an internal combustion engine showing another alternative drive mechanism for driving rotary valves arranged within the cylinder head of the combustion engine.

FIG. 25 shows an end view of another exemplary internal combustion engine 1, such as the one described above. The end view shows yet another alternative drive mechanism for transmitting rotation of a crankshaft 500 to drive shafts 502, 504. The drive mechanism has a rotatable shaft 530 which may, for example, be rotatably supported by the cylinder head 7 of the internal combustion engine 1, or by any other means. An elliptical gear 32 is mounted on the rotatable shaft 530.

Elliptical gears 534 and 536 are also mounted to driveshaft 502, 504, respectively. The elliptical gears 532, 534 and 536 are arranged such that they are in constant engagement. The elliptical gears 534 and 536 are arranged on opposite sides of the elliptical 532. Furthermore, a drive belt 540 is provided which is entrained about the shaft 530 and the crankshaft 500.

Although the example shown in FIG. 25 shows a very specific arrangement of elliptical gears, differently shaped elliptical gears may be used. Furthermore, a different arrangement of such elliptical gears may be used. For example, only two elliptical gears may used which would allow transmitting rotation from the crankshaft 500 to one of the drive shafts 502, 504. A drive mechanism may then be provided to rotatably couple the drive shafts, similar to the setup shown in FIG. 24. Instead of elliptical gears, it is also possible to provide one or more elliptical pulleys and provide a drive element there around.

The characteristics of the elliptical gears or pulleys are that on a constant rotation of one of the elements, the other element will have a varying speed. The speed will vary between a slow and a fast speed. During a single rotation of one elliptical element (such as the one shown), with a constant rotational speed, the other element will have two phases at which it will rotate with a slow speed and two phases at which it will rotate with a fast speed. Depending on the speed changes required during a single rotation, multi-lobe elliptical gears or pulleys may be used.

In general, any two non-circular elements, one rotatably coupled to a drive source, such as the crankshaft and the other rotatably coupled to the drive shaft and which are coupled to cause the above speed variation may be used. The above described speed variation may also be achieved, if an elliptical or non-circular element is coupled to a circular element. In the case of a non-circular pulley coupled to a circular pulley, belt tensioning may be provided to take up any slack occurring during the rotation of the pulleys. If a non-circular gear is used in combination with a circular gear, a mechanism may be provided which allows relative movement between the elements. Such a relative movement allows the distance between the centers of rotation of the gears to vary during rotation of the gears. Such a mechanism may also be used for the pulleys to provide belt tensioning as described above.

Figure 26A:
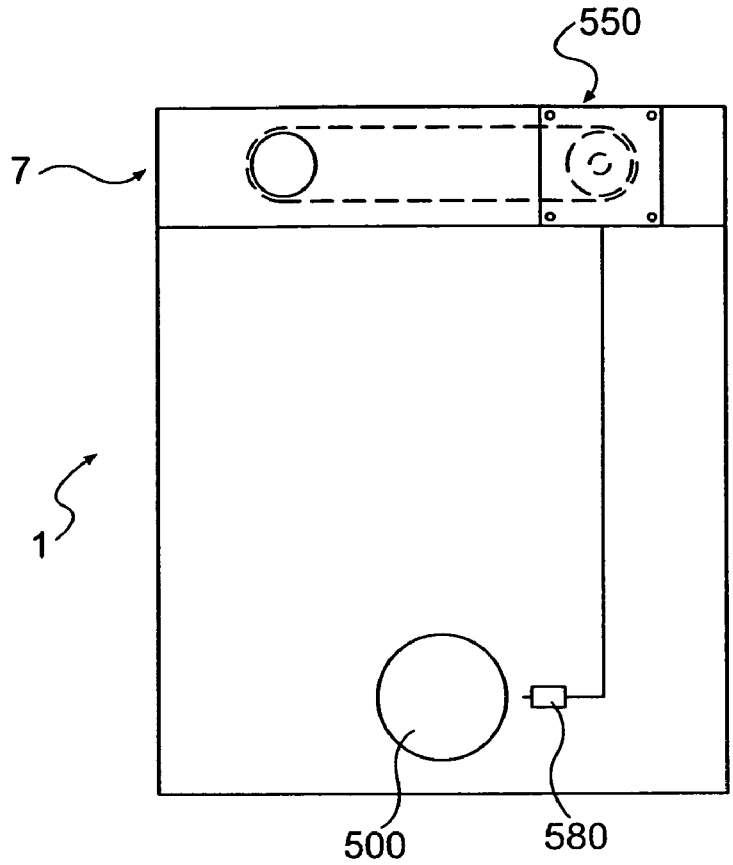
FIG. 26(*a*) is an end view of an internal combustion engine.
Figure 26B:
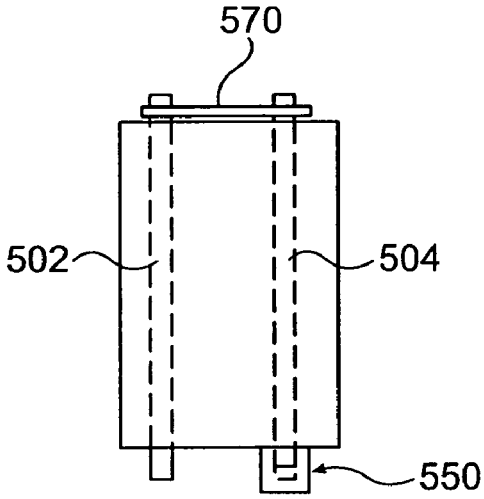
Figure 26C:
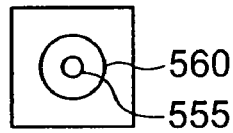

FIG. 26 shows another alternative drive mechanism for drive shafts 502, 504 arranged in a cylinder head 7 of an internal combustion engine 1. The drive mechanism includes an electric drive motor 550 attached to one end face of the cylinder head 7. As can be seen in the different views of FIG. 26, the electric drive motor 550 is arranged such that the drive shaft 504 partially extends therein. As best seen in FIG. 26(*c*), permanent magnets 555 are embedded into the drive shaft 504. The part of the drive shaft 504 in which the permanent magnets 555 are embedded, is surrounded by a stator 560 of the electric motor. The drive shaft 504 thus acts as a rotor of the drive motor 550.

A drive element 570 is provided which is entrained about the drive shafts 502, 504. The drive shaft is provided at an end of the drive shaft 504, which is opposite to the end, which is accommodated in the electric drive motor 550.

FIG. 26(*a*) shows a sensor 580 for sensing the rotational position and speed of the crankshaft 500. The detector 580 is connected to the drive motor 550 to provide information with respect to the rotational position and rotational speed of the crankshaft 500 to the drive motor 550. Alternative sensors, such as a piston position sensor, may be provided. Although the drive motor 550 was described as an electric drive motor, a hydraulic or pneumatic drive motor could be used instead. It is also not necessary that the driveshaft 504 extends into the drive motor 550. A regular drive motor having a rotor and a stator may be provided and the rotor may be coupled to the drive shaft either within or outside of the drive motor. A separate drive motor may be provided for each of the drive shafts thereby eliminating the need of a drive element to transmit rotation between the drive shafts.

The drive motor 550 is arranged to act on the drive shaft 504, which will have rotary valves attached thereto. Rather than having a drive motor 550 acting on a drive shaft, it would also be possible to provide a drive motor which directly acts upon rotary valves accommodated within a cylinder head of an engine. In this case, the rotary valve may have permanent magnets embedded therein, upon which a stator of the drive motor may act. The rotary valves may be journalled on a respective shaft or could be provided on a shaft journalled within the cylinder head. Alternative means for journaling the rotary valves in the cylinder head may be provided.

The stator of such a drive motor may, for example, be attached to the cover plate 12 and in particular to the protrusions described to extend into the insertion passages 32. The stator of such a drive motor may also be formed by interior walls of the valve chamber for accommodating the rotary valve.

With respect to the drive mechanism described hereinbefore, combinations thereof may be formed. It is for example possible to provide a mechanical drive train including gears and/or pulleys between an output of the drive motor and the drive shaft. In particular, non-circular elements may also be used in such a mechanical drive train coupling an output of the drive motor to one or both of the drive shafts.

INDUSTRIAL APPLICABILITY

The previously described cylinder head 7 and its associated parts may be used for any type of combustion engine, especially engines having direct fuel injection. If no direct fuel injection is used, a fuel-air mixture may be provided via the air-duct 47 and its associated valve chambers 24. The cylinder head 7 may be a cast part having certain parts thereof machined after the casting process. In particular, the flow passages 36, the sealing seats surrounding the flow passages 36, the passages 27, 28 and the outside sealing surfaces may be typically machined.

In order to prepare the cylinder head 7 for use with an internal combustion engine, the different parts associated therewith are assembled. Such an assembly will now be described with respect to FIG. 6, showing a longitudinal cross section through the cylinder head 7.

The view according to FIG. 6 shows a cross section through group B of the valve chambers 24 and through passage 28. In the following, reference will thus be made to those valve chambers and to passage 28. Assembly of the valve chambers 24 and associated parts with respect to group A will be performed in a similar manner.

In a first step, bearings will be arranged in the passage 28. Each part of the passage 28 being arranged between adjacent valve chambers 24 will receive two bearings, such as bearings 402 therein. Additional bearings, which may be of the same shape and design, like the bearings 402, may be arranged in the parts of the passage 28 extending between the outermost valve chambers 24 and the end faces 17, 18, respectively.

In a next step, deflectors, such as deflectors 404 will be arranged adjacent the bearing received in the passage 28. The deflecting surface of the deflectors is arranged to face towards the inside of the valve chambers 24. Rather than having separate bearings and deflectors, an integrated deflector bearing assembly as shown in FIG. 22 could be used instead.

In a next step, rotary valves, such as rotary valves 30, will be inserted into the valve chambers 24 through their respective insertion opening 32. Next, a drive shaft, such as drive shaft 300 will be subsequently inserted through bearings in the passage 28, a deflector 404 in a first valve chamber 24, a first rotary valve 30 in the valve chamber, a second rotary valve 30 in the valve chamber, a second deflector 404 in the valve chamber, bearings in the passage etc. During this assembly, the drive shaft may be cooled via its central cooling passage to cause shrinking thereof, in order to allow a better insertion through the several parts of the assembly.

Once the drive shaft is inserted through all the parts of the assembly and exits the opposite end of the cylinder head 7, the mounting holes 310 in the drive shaft are aligned with the opening 238 in the rotary valves 30. This alignment will be observed through the insertion opening 32 and will be performed in pairs. Once a opening 238 in a drive shaft 30 is aligned with a corresponding mounting hole 310 in the drive shaft 300, the dowel pin 330 is inserted through the opening 238 into the top part of the mounting opening 310.

Finally, a screw 335 is inserted into the assembly and is screwed into the inner part of the mounting hole 310 of the drive shaft 300.

In this manner, each of the rotary valves 30 is mounted to the drive shaft 300. As mentioned above, this final assembly of the rotary valves 30 is done in pairs, as the groups 312 to 318 of mounting holes 310 are rotationally offset. Inasmuch as the alignment of the mounting holes and the insertion of the dowel pin and the screw are performed through the insertion opening 32, the rotary valves are kept in a constant position, and the drive shaft is to be rotated, to achieve alignment of the mounting holes. It may also be possible to assemble the drive shaft and the componentry associated therewith outside of the cylinder head and to insert such an assembly through a corresponding passage formed either longitudinally or transversely in the cylinder head. In a cylinder head of the split design such an assembly may be inserted before attaching the separate body parts of the cylinder head to each other.

Once this assembly is completed, injectors may be mounted to the cylinder head 7 by inserting injectors through the corresponding injector openings 67. Once the cylinder head 7 is pre-assembled in this manner, it may be mounted to the engine main body, by bolts extending through the mounting holes 65 into corresponding mounting holes in the engine main body.

Finally, the cover plate 12 may be placed onto the cylinder head 7 and attached thereto by bolts extending through the mounting holes 69 and 70. Once the cylinder head 7 is mounted to the engine main body, a drive mechanism is coupled to the drive shafts. Furthermore, an exhaust manifold is attached to side 20 of the cylinder head 7 to fluidly connect each of the passages 60 to the exhaust manifold. Similarly, air inlet pipes are connected to the top surface 15 of the cylinder head 7, to fluidly connect to passages 49 and 50 connected to the air-duct 47. The opening 48 in the end face 18 may be closed by a cover plate or plug. Alternatively, another air inlet pipe could be connected to end face 18, to provide airflow to the air-duct 47.

During operation of the engine, each of the rotary valves 30 will provide successive opening and closing events for its corresponding flow passage 36. The rotary valves 30 associated with group A of the valve chambers will mainly provide intake of air into the respective engine cylinders during an intake stroke and will prevent fluid flow into the respective valve chambers during a closing event. If an in-cylinder charge dilution (ICCD) is desired, i.e. a mixing of intake air with exhaust gas, for example aimed at reducing emissions such as nitrogen oxides (NOx) during combustion, a certain degree of gas flow from the cylinders to the valve chambers associated with group A may be provided. Such a gas flow may for example be provided by additional flow openings, such as flow opening 260 shown in FIG. 17 or flow openings 276 to 278 shown in FIG. 18. It is also possible, that such a gas flow may be provided by incomplete sealing between the sealing arrangement 44 and the rotary valve 30 at least during a part of a rotation thereof. Such an incomplete sealing could be achieved by providing sections in the spherical zone 204 of each rotary valve deviating from a rotational symmetry thereof.

Another alternative is to rotate each of the rotary valves 30 such that two opening events by the openings 226 to 228 occur during a single combustion cycle of the engine i.e. the rotary valve may make two revolutions during a single combustion cycle. In this event, the rotational speed of the rotary valves 30 could be varied, such that the opening events are of a different duration. In some embodiments a longer air intake opening duration may be used.

The rotary valves associated with group B of the valve chambers 24 similarly provide opening events to exhaust gas from the respective cylinders through the respective flow passages 36, the flow passage 226, 228 in the rotary valves 30, into the respective valve chamber 24 and through the respective exhaust passage 60 to the exhaust manifold.

In order to achieve ICCD, rather than admitting exhaust gas into the valve chambers 24 of group A, it is also possible to allow exhaust gas from the valve chamber 24 associated with group B to flow into the respective cylinders during an intake stroke. Such an air flow occurring outside of the main opening event of the rotary valves for exhausting gas from the cylinders, may occur in a similar manner as described before. Additional flow openings 260 to 278 may be provided, incomplete sealing between the rotary valves 30 and their corresponding sealing arrangement may be provided or the valves may be driven at a speed to achieve two or more separate valve opening events of the same openings during a single combustion cycle of the engine. Fuel may be injected via the respective injectors in accordance with engine requirements. Alternatively a fuel-air mixture may be provided via valve chambers 24 of group A.

The cylinder head 107 shown in FIG. 10 will be assembled in a similar manner to the cylinder head 7, and operation thereof will be similar to the one described before. The main difference lies in the fact that an air inlet manifold and an exhaust manifold will be attached to parts 181, 182, respectively, of the top surface 115 of the cylinder head 107. Air will enter directly through the insertion opening 132 into the respective valve chambers 124 of group A rather than through an air-duct 47 and flow passages 55. Similarly, exhaust gas will directly exit the respective valve chambers of group B through insertion openings 132 into the exhaust manifold.

With respect to FIGS. 23 to 26 different drive arrangements are shown. In accordance with FIGS. 23 and 24, rotation of the crankshaft 500 of the engine 1 is transmitted directly via a mechanical drive train to the respective drive shafts 502, 504, arranged in the cylinder head 7. The mechanical drive train is designed such that a constant rotation of the crankshaft 500 will translate into a constant rotation of the drive shafts 502, 504. Even though not shown, a speed reduction mechanism may be provided, such that each of the drive shafts 502, 504 will run for example at half speed of the crankshaft 500. In the case of rotary valves having two main flow passages there through, the rotational speed of each of the drive shafts 502, 504 may even be reduced to a quarter speed of the crankshaft 500.

FIG. 25 shows an alternative mechanical drive train for transmitting rotation of the crankshaft 500 to the drive shaft 502, 504. This mechanical drive train uses elliptical gears being in engagement with each other. The elliptical gears have the effect, that upon a constant rotation of the crankshaft 500 the rotational speed of each of the drive shafts 502, 504 will vary between a low speed and a fast speed. In providing such a speed variation, for example, fast opening and closing of the rotary valves may be achieved. Even though FIG. 25 shows elliptical gears of the bi-lobe type, multi-lobe elliptical gears may be used. Indeed, any type of non circular gear providing a speed variation such as the one described above could be used. The speed of the drive shaft will vary about a reference speed, which is associated with the rotational speed of the source of rotation. The reference speed will depend on the speed reduction mechanism, if any is used. Without a speed reduction mechanism, the reference speed will be equal to the speed of rotation of the crankshaft.

Although FIG. 25 shows elliptical gears being in engagement, elliptical pulleys being connected by drive belts could be used. They may produce the same effect. The elliptical gears shown in FIG. 25 will produce during a single rotation of the crankshaft 500 two short periods, in which the rotary shafts 502, 504 are rotated at a high speed and two longer periods, at which the rotary shafts 502, 504 rotate at a slower speed. Depending on the number of rotary valves attached to the drive shafts and the engine requirements, multi-lobe elliptical gears having a different number of speed changes may be used.

FIG. 26 shows an alternative drive mechanism for the drive shafts 502, 504. In the example shown in FIG. 26, an electric drive motor is used to drive the drive shaft 504. Rotation of the drive shaft 504 is then transmitted to the drive shaft 502 via a drive belt 570. A sensor 580, which detects the rotational position and speed of the crankshaft 500 is connected to the drive motor 550, to transmit this information thereto. In accordance with this information, the drive motor 550 can rotate the drive shafts 505, 502, respectively. The drive motor 550 may be driven at varying speeds during a single rotation thereof. This may allow fast opening and closing of the rotary valve. The varying speeds may again vary about a reference speed associated with a crankshaft speed.

Rather than providing a drive motor 550 for one of the drive shafts and providing a mechanical drive train between the drive shafts to couple them together, two separate drive motors may be provided. This would add the possibility to independently control rotation of each of the drive shafts. Especially in cases where a single rotary valve is attached to the drive shaft, or where a drive shaft is associated with rotary valves for a single cylinder, individual tailoring of opening, closing and the speed of rotation thereof is possible. In this way, the amount of fluid flow to and from the cylinder may be individually adjusted for the cylinder. Similar control is possible in the application where the drive motor acts directly on the rotary valves, for example, when the rotary valves have magnets embedded therein, as described above. Such an individual tailoring may be particular beneficial in combination with a corresponding tailoring of the amount of fuel to be injected.

An electronic control unit may be provided to control operation of the drive motor. Even though FIG. 26 shows an electric drive motor, similarly a hydraulic drive motor may be provided.

The above description describes several examples for a cylinder head of an internal combustion engine and its associated componentry. The present application, however, is not limited to the specific examples shown therein. Features of the different examples for the elements may be combined and/or exchanged.

It will be apparent to those skilled in the art that various modifications and variations can be made to the method of the present disclosure. Other embodiments of the method will be apparent to those skilled in the art from consideration of the specification and practice of the method disclosed herein. It is intended that the specification and examples be considered as exemplary only, with a true scope being indicated by the following claims and their equivalents.

What is claimed is:

1. A method for providing a mixture of inlet air and exhaust gas in a cylinder of an internal combustion engine, in which fluid flow between the cylinder and a cylinder head associated therewith is controlled by one or more rotary valves accommodated in the cylinder head, the method comprising:

rotating the one or more rotary valves to allow a fluid flow between the cylinder and the cylinder head in a first direction and to allow a fluid flow between the cylinder and the cylinder head in a second direction, opposite the first direction, wherein the fluid flow in the first direction and the fluid flow in the second direction are allowed during a single combustion cycle of the engine; and successively overlapping at least two openings of one of the one or more rotary valves with a flow passage in the cylinder head during rotation of the one rotary valve;

wherein the fluid flows in the first direction and the second direction are respectively allowed by at least partially overlapping at least two different openings with respective flow openings in the cylinder head, the at least two openings being defined in a curved portion of the one rotary valve, which curved portion is rotationally symmetric with respect to an axis of rotation of the one rotary valve; and wherein the at least two openings are rotationally offset from one another and define different flow areas.

2. The method of claim 1, including varying the speed of rotation of at least one of the one or more rotary valves to be higher during at least one of a beginning and an end of an overlapping event compared to an average speed of rotation of the at least one rotary valve.

3. The method of claim 1, including blocking fluid flow through the flow passage by the at least one rotary valve between the successive overlapping events.

4. The method of claim 1, including controlling the amount of fluid flow allowed to flow in the first direction to be different from the amount of fluid flow allowed to flow in the second direction.

5. The method of claim 1, wherein the speed of rotation of at least one of the one or more rotary valves is changed during a single rotation thereof.

6. The method of claim 5, wherein the speed of rotation at the time in which the fluid flow is allowed in the first direction is different from the speed of rotation at the time the fluid flow is allowed in the second direction.

7. The method of claim 1, wherein fluid flow in the first and the second directions is allowed during at least two valve opening events, respectively, wherein the two valve opening events are separated by a valve closing event.

8. The method of claim 1, wherein fluid flow in the first and the second directions is allowed during a singular valve opening event.

9. The method of claim 1, wherein the combustion cycle is a four stroke cycle, wherein fluid flow in the first direction is allowed while an intake stroke occurs in the cylinder and fluid flow in the second direction is allowed while an exhaust stroke occurs in the cylinder.

10. The method of claim 1, including controlling the amount of fluid flowing in the first direction to be larger than the amount of fluid flowing in the second direction.

11. The method of claim 1, including controlling the amount of fluid flowing in the first direction to be smaller than the amount of fluid flowing in the second direction.

12. The method of claim 1, including controlling fluid flow between the cylinder and a cylinder head associated therewith by at least two rotary valves accommodated in the cylinder head, a first rotary valve being arranged to control fluid flow between a first part of the cylinder head, fluidly connected to an air supply, and the cylinder and a second rotary valve being arranged to control fluid flow between the cylinder and a second part of the cylinder head, fluidly connected to an exhaust, the method comprising:

rotating at least one of the first rotary valve and the second rotary valve to allow a fluid flow in a first direction between the cylinder and its respective part of the cylinder head and to allow a fluid flow in a second direction, opposite the first direction, between the cylinder and its respective part in the cylinder head wherein the fluid flow in the first direction and the fluid flow in the second direction are allowed during a single combustion cycle of the engine.

13. The method of claim 12, including varying the speed of rotation of the rotary valves to be higher during at least one of a beginning and an end of an overlapping event compared to an average speed of rotation of the rotary valves.

14. The method of claim 12, wherein two or more of the at least two rotary valves are accommodated in a common valve chamber; and wherein rotary valves accommodated in the common valve chamber are of the same shape, are aligned with respect to the direction of rotation thereof, and are synchronously rotated.

15. The method of claim 12, wherein two or more of the at least two rotary valves are accommodated in a common valve chamber; and wherein rotary valves accommodated in the common valve chamber are of the same shape, are offset with respect to the direction of rotation thereof, and are synchronously rotated.

16. The method of claim 12, wherein two or more of the at least two rotary valves are accommodated in a common valve chamber; and wherein rotary valves accommodated in the common valve chamber have different shapes.

17. The method of claim 12, wherein the rotary valves are rotated with different speeds.

* * * * *